US006343913B1

(12) United States Patent
Ohsaki

(10) Patent No.: US 6,343,913 B1
(45) Date of Patent: Feb. 5, 2002

(54) HYDRAULIC TURBOMACHINE

(75) Inventor: Akihiro Ohsaki, Tokyo (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/509,489

(22) PCT Filed: Sep. 30, 1998

(86) PCT No.: PCT/JP98/04406

§ 371 Date: May 31, 2000

§ 102(e) Date: May 31, 2000

(87) PCT Pub. No.: WO99/17024

PCT Pub. Date: Apr. 8, 1999

(30) Foreign Application Priority Data

Sep. 30, 1997 (JP) ..... 9-284385

(51) Int. Cl.[7] ..... F01D 1/02
(52) U.S. Cl. ..... 415/199.2; 415/200
(58) Field of Search ..... 415/199.2, 172.1, 415/170.1, 199.1, 199.3, 206, 200

(56) References Cited

FOREIGN PATENT DOCUMENTS

JP 354104007 A * 8/1979 ..... 415/127

* cited by examiner

*Primary Examiner*—Edward K. Look
*Assistant Examiner*—James M McAleenan
(74) *Attorney, Agent, or Firm*—Armstrong, Westerman, Hattori, McLeland & Naughton, LLP

(57) ABSTRACT

There is provided a hydraulic turbomachine comprising a housing, one or more impellers arranged rotatably around an axis within the housing, one or more resin-made diffusers provided around the one or more impellers for defining diffuser channels around the impellers, respectively, one or more support members provided within the housing and engaged under pressure with corresponding ones of the diffusers for securely supporting the corresponding diffusers in the direction of the above-noted axis within the housing, and elastic members held between surfaces of the support members and the diffusers in the above-noted direction. An O-ring receiving groove is formed in each of the surfaces of the diffusers in such a manner that the groove surrounds the axis, and an O-ring is placed in the groove as the elastic member.

4 Claims, 2 Drawing Sheets

HYDRAULIC TURBOMACHINE

TECHNICAL FIELD OF THE INVENTION

The present invention relates to a hydraulic turbomachine such as a pump, and in particular, the present invention relates to a diffuser provided in such a hydraulic turbomachine for defining a diffuser channel around an impeller of the turbomachine.

BACKGROUND OF THE INVENTION

FIG. 2 shows an example of a two-stage pump with a built-in motor, which is one variety of such a hydraulic turbomachine. This pump has a motor part 16 and a pump part 18 which have a rotating shaft 14 in common, and their respective housings 20 and 22 are joined adjacently to each other, with a separating wall 24 disposed between them.

The housing of the pump part 18 has an inlet port 26 and a discharge port 28. There are disposed in the housing a first-stage impeller 34 and a second-stage impeller 36 securely connected to the rotating shaft 14, and resin-made diffusers 40 and 42 provided around the first and second-stage impellers for defining diffuser channels around the impellers, respectively. Intermediate casings 46 and 48 are provided respectively around each set of the impeller and the corresponding diffuser in order to support the diffusers within the housing and to form first-stage and second-stage pumping chambers.

The diffuser 42 of the second-stage pumping chamber is cramped in an axial direction or a direction of extension of the shaft 14 between a cylindrical pressing member 52 extending the axial direction from the separating wall 24 and a radially extending wall 48*a* of the second-stage intermediate casing 48, positioned on the upstream side thereof. Furthermore, the diffuser 40 of the first-stage pumping chamber is cramped between the wall 48*a* of the intermediate casing 48 and a radially extending wall 46*a* of the first-stage intermediate casing, positioned on the upstream side thereof.

Flanges 50 and 53 are formed along outer peripheral edges of the housings 20 and 22 of the motor part 16 and the pump part 18 which are positioned close to each other, and between the flanges 50 and 52*a* is cramped a flange 58 provided on the circumference of the separating wall 24. Bolts 64 are passed through axially aligned holes formed in these flanges 50, 53, and 58, and are fastened with nuts 68.

This fastening of the bolts and the nuts securely fastens the housings 20 and 22 and, at the same time, the fastening force is transferred to the second-stage diffuser through the pressing member 52 of the separating wall 24 and, accordingly, the second-stage diffuser 42, the second-stage intermediate casing 48, the first-stage diffuser 40, and the first-stage intermediate casing 46 are tightly fastened together between the pressing member 52 and a radially extending wall 20*a* of the housing 20 having the inlet port 26.

However, in such a pump, since the fastening force imparted by the bolts and the nuts is directly applied to the diffusers, it is necessary for the diffusers to be formed of a resin material with sufficient hardness and high tenacity to withstand such a load. Alternatively, it is necessary for the diffusers to be formed thick in the axial direction. However, highly tenacious resin materials have poor moldability, and the production of a thick diffuser increases costs.

Moreover, since the diffuser and the intermediate casing are engaged with each other directly, it is required that the surfaces thereof engaged with each other be finely finished thereby raising costs.

The present invention takes the above into consideration and aims to provide a hydraulic turbomachine such as a pump which can use a thin diffuser molded from a resin material with relatively low tenacity.

DISCLOSURE OF THE INVENTION

In accordance with the present invention, a hydraulic turbomachine comprises a housing, one or more impellers arranged rotatably around an axis within the housing, one or more resin-made diffusers provided around the above-noted one or more impellers, respectively, for defining diffuser channels around the impellers, one or more support members provided within the housing and pressed axially by corresponding ones of the diffusers for securely supporting them a direction of the above-noted axis within the housing, and elastic members held between surfaces of the support members and the diffusers the surface of which are, as noted above, axially pressed against each other.

Specifically, the above-noted support members may be intermediate casings disposed around each set of the impellers and the corresponding diffusers provided therearound to form pumping chambers within the housing.

Since, in the present invention, the diffuser and the support member or intermediate casing are not directly engaged with each other, and, instead, are engaged indirectly with each other with the elastic member being interposed therebetween, the fastening force axially imposed on the diffuser can be uniform across the engaging surface, whereby a resin material of the diffuser can have little tenacity as compared with that of the above-noted prior diffuser. Further, it is not necessary for the surfaces of the diffuser and the support member to be highly finished. Consequently, it is possible for the diffuser to be produced at low costs as compared with the above-stated prior art diffuser.

More specifically, the intermediate casing is provided with an O-ring receiving groove in a surface against which the diffuser is engaged in such a manner that the groove surrounds the axis around which the impeller rotates and an O-ring is placed in the groove as the elastic member.

PREFERRED EMBODIMENT

A most preferred embodiment of the hydraulic turbomachine according to the present invention will be explained with reference to FIG. 1.

Figure 1:
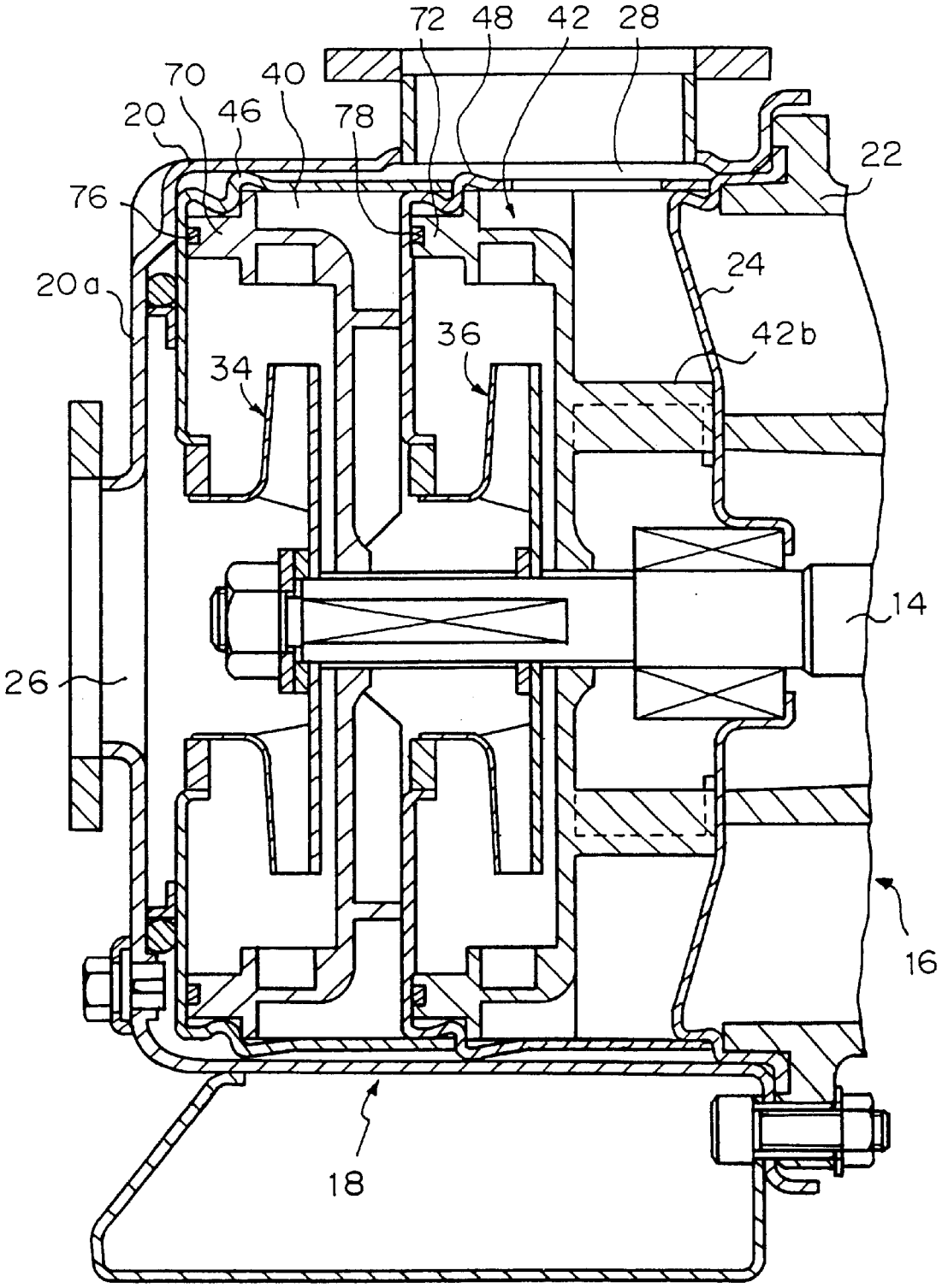
FIG. 1 is a sectional view of the hydraulic turbomachine according to the present invention.
Figure 2:
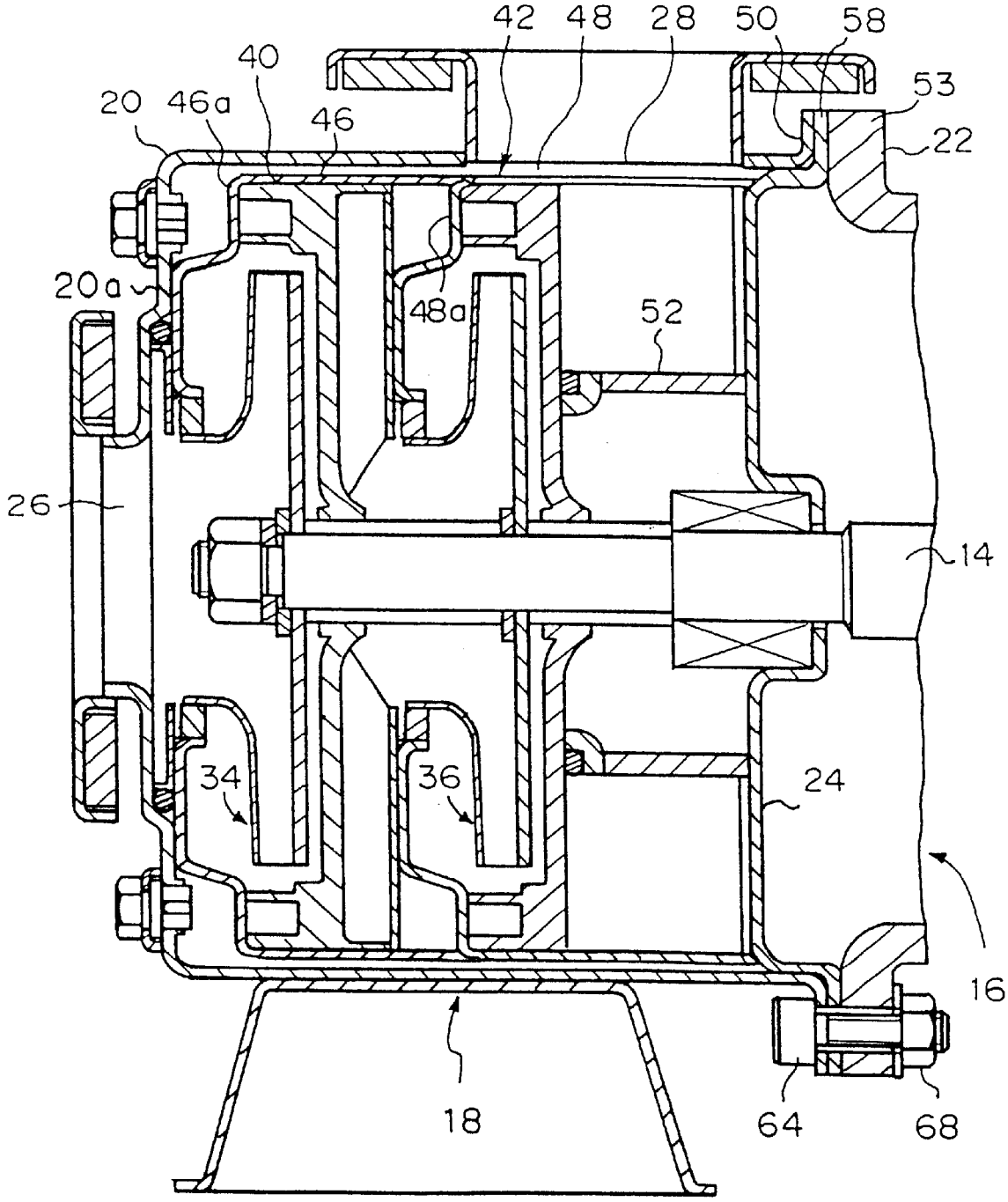
FIG. 2 is a sectional view of conventional hydraulic turbomachine.

The hydraulic turbomachine shown in FIG. 1 is a pump having the same basic constitution as that shown in FIG. 2. Therefore, in the description given below, the same reference numbers are used for the same elements as those in FIG. 2.

The pump is partitioned by the separating wall 24, and has the motor part 16 and the pump part 18 which have the rotating shaft 14 in common. The housing of the pump part 18 has the inlet port 26 and the discharge port 28. The rotating shaft 14 is securely provided with the first-stage impeller 34 and the second-stage impeller 36 and the resin-made diffusers 40 and 42 are provided around the corresponding impeller 34 and 36. The intermediate casings 46 and 48 are provided respectively around the diffusers 40 and 42 provided around the impellers 34 and 36 to form the first-stage and second-stage pumping chambers.

The diffuser 42 of the second-stage pumping chamber has pressing part 42*b* extending from the surface thereof on the side of the motor part to the separating wall 24 in such a manner that the pressing part 42*b* is engaged with the separating wall 24 under an axial pressure therebetween and, due to the axial pressure, the second-stage intermediate casing 48, the first-stage diffuser 40, and the first-stage intermediate casing 46 are pressed towards the inlet port, and held against the radially extending housing wall 20*a* having the inlet port 26.

Formed on the peripheral edges on the upstream side of the diffusers 40 and 42 are thick parts 70 and 72 that are formed with O-ring receiving grooves 76 and 78, respectively. In the O-ring receiving grooves, elastic members or O-rings are placed, so that the diffusers will not have direct contact with the intermediate casing in the axial direction.

INDUSTRIAL APPLICATION OF THE INVENTION

In the above most preferred embodiment, there was given a description of a case where the present invention is used in a pump, but the present invention can be used in other types of hydraulic turbomachines comprising impellers and diffusers provided around the impellers.

What is claimed is:

1. A hydraulic turbomachine comprising a housing, one or more impellers arranged rotatably around an axis within said housing, one or more resin-made diffusers provided around said one or more impellers, respectively, for defining diffuser channels around said impellers, one or more support members provided within said housing and engaged under pressure with corresponding ones of said diffusers in the direction of said axis thereby securely supporting them in said direction within the housing, and elastic members held between and contacting the surfaces of said one or more support members and said one or more diffusers to be engaged with each other in said direction.

2. A hydraulic turbomachine of claim 1, wherein an O-ring receiving groove is formed in each of said surfaces of said diffusers in such a manner that the groove surrounds said axis, and an O-ring is placed in said groove to act as said elastic member.

3. A hydraulic turbomachine comprising a housing, one or more impellers arranged rotatably around an axis within said housing, one or more resin-made diffusers provided around said impellers, respectively, for defining diffuser channels around the respective impellers, one or more intermediate casings disposed around each set of said impellers and said diffusers provided therearound within the housing to form pumping chambers, respectively, the intermediate casings being engaged under pressure with corresponding ones of said diffusers in a direction of said axis, and elastic members held between and contacting the surfaces of said one or more support members and said one or more diffusers to be engaged with each other in said direction.

4. A hydraulic turbomachine of claim 3, wherein an O-ring receiving groove is formed in each of said surface of said diffusers in such a manner that the groove surrounds said axis, and an O-ring is arranged in said groove to act as said elastic member.

* * * * *